United States Patent [19]

Shiozawa

[11] Patent Number: 4,938,182

[45] Date of Patent: Jul. 3, 1990

[54] ENGINE CYLINDER HEAD

[75] Inventor: Shigeki Shiozawa, Hamamatsu, Japan

[73] Assignee: Sanshin Kogyo Kabushiki Kaisha, Shizuoka, Japan

[21] Appl. No.: 289,983

[22] Filed: Dec. 22, 1988

[30] Foreign Application Priority Data

Dec. 25, 1987 [JP] Japan ..... 62-327311

[51] Int. Cl.[5] ..... F02F 1/24

[52] U.S. Cl. ..... 123/193 H

[58] Field of Search ..... 123/193 H, 193 CH, 169 R; 29/156.4 R

[56] References Cited

U.S. PATENT DOCUMENTS

| | | | |
|---|---|---|---|
| 3,683,873 | 8/1972 | Tartar | 123/169 R |
| 4,146,004 | 3/1979 | Dubois | 123/193 CH |
| 4,182,279 | 1/1980 | Sato et al. | 123/193 H |
| 4,230,087 | 10/1980 | Abe et al. | 123/193 CH |
| 4,582,028 | 4/1986 | Wagner et al. | 123/193 CH |
| 4,757,789 | 7/1988 | Laine | 123/193 H |

*Primary Examiner*—Willis R. Wolfe
*Assistant Examiner*—M. Macy
*Attorney, Agent, or Firm*—Ernest A. Beutler

[57] ABSTRACT

Two embodiments of cylinder head constructions including drain passageways for draining the sealing area of a spark plug of water. In one embodiment, the drain passageway is formed when the cylinder head is cast and in the other embodiment, the drain passageway is machined into the cylinder head.

8 Claims, 3 Drawing Sheets

ENGINE CYLINDER HEAD

BACKGROUND OF THE INVENTION

This invention relates to an engine cylinder head and more particularly to an improved mounting arrangement for the spark plug of an internal combustion engine.

As is well known, the spark plugs for an internal combustion engine just positioned so that their gaps extend into the appropriate location within the combustion chamber. However, the spark plugs should also be positioned in an area where they can readily serviced and also where they will not interfere with other components of the engine such as the intake and exhaust valves, driving camshaft and the like. Naturally, the spark plug has a threaded portion that is received within a threaded opening formed in the mounting part of the engine, normally the cylinder head. This threaded opening of the cylinder head is surrounded by a recessed sealing area against which the spark plug seals so as to permit a compression seal for the engine.

This type of construction, however, has certain difficulties. Normally, the spark plug sealing area does not extend vertically and, hence, it defines a pocket in which foreign material such as water or other contaminants can collect. This presents a number of disadvantages. For example, the accumulation of water in the spark plug recess can cause corrosion. Furthermore, when the spark plug is removed for servicing, the accumulated water may enter the combustion chamber and sweep with it other foreign deposits. This additionally presents the likelihood of contaminants reaching the spark plug threads and damaging the cylinder head when the plug is next installed.

It is, therefore, a principal object of this invention to provide an improved engine cylinder head.

It is a further object of this invention to provide a mounting arrangement for a spark plug wherein the well in which the spark plug is positioned will be drained of foreign materials and particularly liquids.

SUMMARY OF THE INVENTION

This invention is adapted to be embodied in an internal combustion engine that has a body which defines a spark plug receiving opening that is surrounded by a recessed sealing area that is inclined to the vertical. In accordance with the invention, a drain passage extends from the sealing area downwardly to a discharge for discharging any accumulated fluids from the sealing area.

DETAILED DESCRIPTION OF THE PREFERRED EMBODIMENTS

Figure 1:
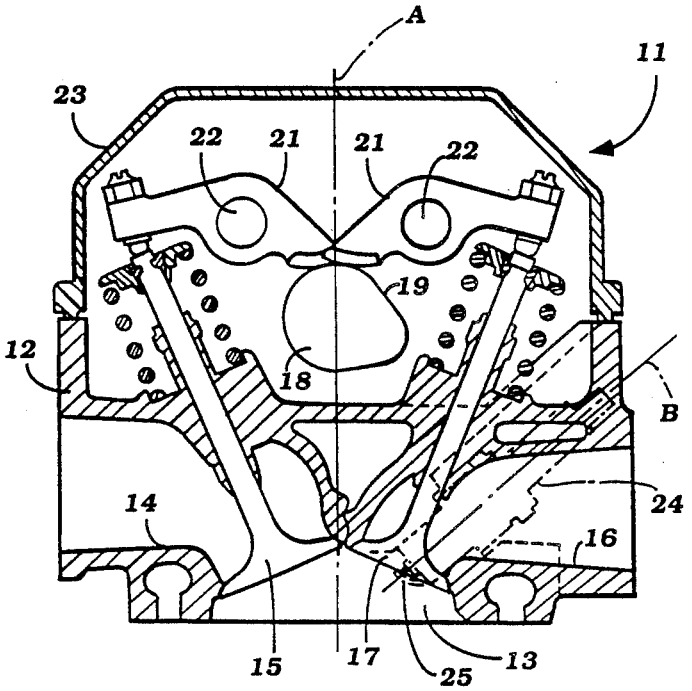
FIG. 1 is a cross-sectional view taken through the cylinder head of an internal combustion engine constructed in accordance with an embodiment of the invention.

Referring first to FIG. 1, a cylinder head of an internal combustion engine constructed in accordance with an embodiment of the invention is identified generally by the reference numeral 11. The invention is described in conjunction with a cylinder head inasmuch as the spark plugs of the engine are normally mounted in the cylinder head. It is to be understood, however, that the invention can also be practiced in conjunction with the mounting of spark plugs for engines in other components of the engine than the cylinder head.

The cylinder head assembly 11 is comprised of a cylinder head 12 that defines a recessed area 13 that cooperates with the cylinder block, cylinder bore and piston all of which are not shown) in a known manner.

An intake port 14 opens through one side of the cylinder head and enters into the combustion chamber recess 13. A poppet type intake valve 15 is slidably supported within the cylinder head 12 in a known manner so as to control the flow through the intake port 14.

In a similar manner, an exhaust port 16 opens through the opposite side of the cylinder head 12 and communicates with the combustion chamber 13. A poppet type exhaust valve 17 controls the flow through the exhaust port.

The intake and exhaust valves 15 and 17 are operated by means of a single overhead camshaft 18 which is driven from the engine output shaft in a known manner. The camshaft 18 has lobes 19 that cooperate with rocker arms 21 that are journaled upon rocker arm shafts 22 for operating the valves 15 and 17 in a known manner. This valve operating mechanism including the camshaft 18 is enclosed within a cam cover 23.

A spark plug 24 is mounted in the cylinder head 12 and has its spark terminals 25 disposed within the combustion recess 13 for firing the charge therein in a known manner. The spark plug 24 is mounted so that its longitudinally extending axis, indicated by the line B, is inclined to the cylinder bore axis, indicated by the line A, which is vertically disposed in the illustrated embodiment. As a result, the spark plug axis B is offset to both the vertical and horizontal.

Figure 2:
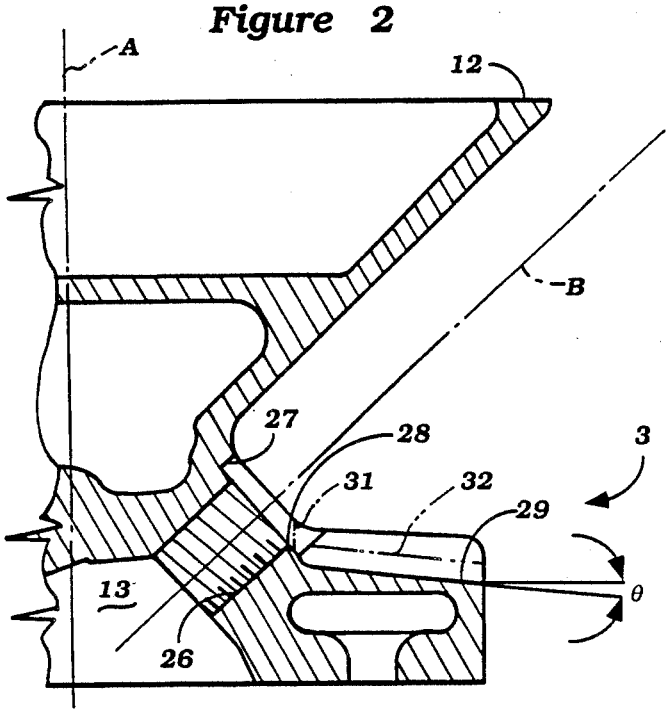
FIG. 2 is an enlarged cross-sectional view taken through the spark plug receiving opening.
Figure 3:
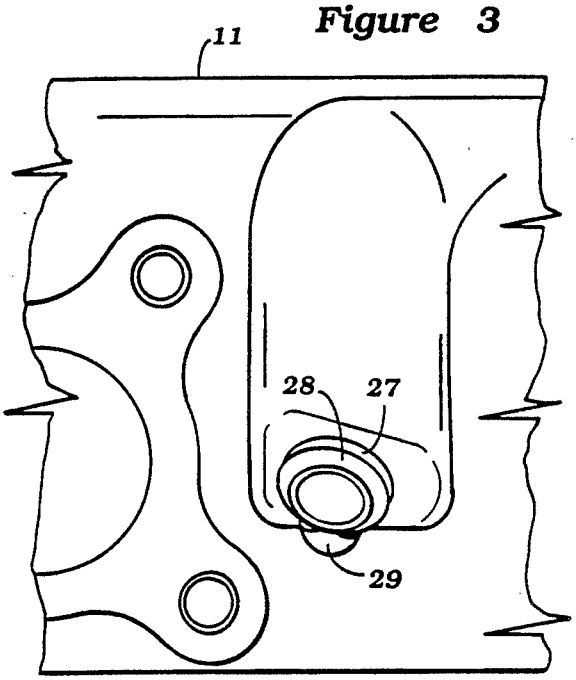
FIG. 3 is a side elevational view looking in the direction of the arrow 3 in FIG. 2.

Referring now in detail to FIGS. 2 and 3, as is conventional, the spark plug receiving recess of the cylinder head 12 is comprised of an internally threaded opening 26 that is surrounded by a recessing seating area 27 having a seating surface 28 that is adapted to be engaged by a sealing gasket carried by the spark plug 24. Alternatively, the surface 28 may be slightly tapered so as to directly engage with a corresponding tapered surface of the spark plug for direct sealing. In either event, it will be noted that the recess or well 27 forms an area that is inclined to the vertical and hence provides an area wherein water can accumulate with the aforenoted deleterious effects.

In accordance with the invention, there is provided a drain passageway, indicated generally by the reference numeral 29, which mates with the lower portion of the well 27 and which is made up of a vertically extending part 31 and a horizontally extending part 32. The horizontally extending part 32 is inclined to the horizontal by the angle $\theta$ so that any water accumulating in the well 27 will drain from the passageway 29 and flow away therefrom. As a result, the aforenoted problems are clearly avoided with this simple yet highly effective arrangement.

Figure 4:
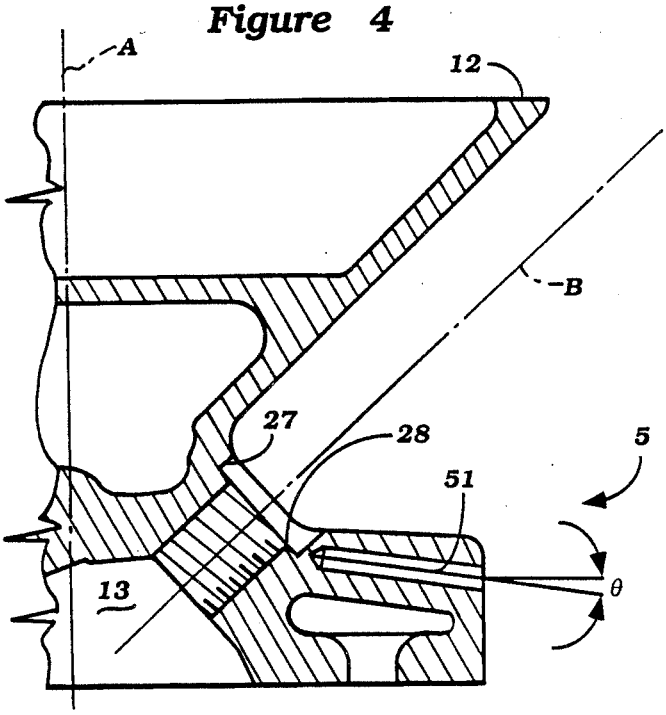
FIG. 4 is a cross-sectional view, in part similar to FIG. 2, showing another embodiment of the invention.
Figure 5:
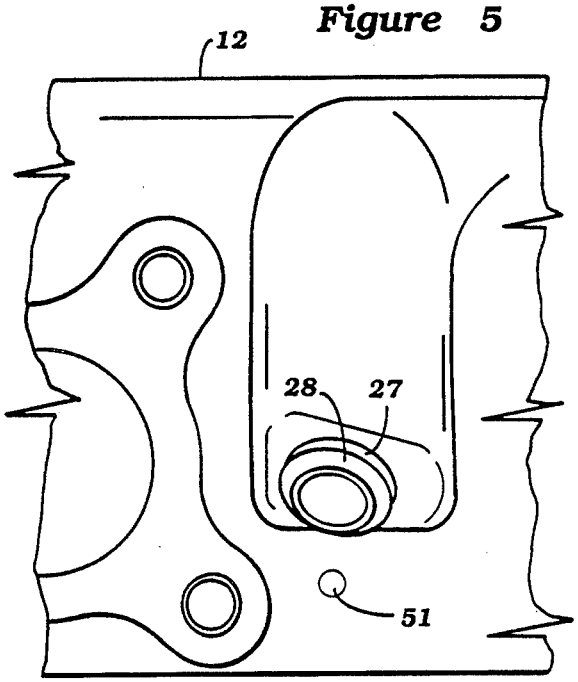
FIG. 5 is a side elevational view looking in the direction of the arrow 5 in FIG. 4.

FIGS. 4 and 5 show another embodiment of the invention. In the previously described embodiment, the passageway 29 for draining the well 27 opened through the upper surface of the cylinder head 12 and thus may conveniently during the casting of the cylinder head. This embodiment shows an arrangement wherein a drilled drain passageway, indicated generally by the reference numeral 51, is employed for the same draining purpose. Because it is only the configuration of this passageway which differs from the previously described embodiment, those components which are the same have been identified by the same reference numerals and will be described again only insofar as is necessary to understand the construction and operation of this embodiment.

It will be noted that the drilled passageway 51 is drilled from an external surface of the cylinder head 12 at an angle ¼ to the horizontal so that it will travel upwardly and intersect the well 27 at its lowest point. As a result, the aforenoted draining of the well is achieved through a very simple yet highly effective arrangement.

It is to be understood that the two embodiments of the invention specifically illustrated and described are only typical of various forms which the invention can take. Various changes and modifications are possible without departing from the spirit and scope of the invention, as defined by the appended claims.

I claim:

1. In an internal combustion engine comprising a body of said engine defining a spark plug recess opening surrounded by a recessed sealing area that is inclined to the vertical, the improvement comprising a drain passage extending downwardly from said sealing area to drain any accumulated fluid therefrom.

2. In an internal combustion engine as set forth in claim 1 wherein the recessed sealing area defines a well and the inlet portion of the passageway intersects the lowest portion of the well.

3. In an internal combustion engine as set forth in claim 2 wherein the drain passageway is formed as a recess in an external surface of the body.

4. In an internal combustion engine as set forth in claim 2 wherein the drain passage comprises a drilled passageway intersecting the well.

5. In an internal combustion engine as set forth in claim 1 wherein the body of the engine comprises a cylinder head.

6. In an internal combustion engine as set forth in claim 5 wherein the recessed sealing area defines a well and the inlet portion of the passageway intersects the lowers portion of the well.

7. In an internal combustion engine as set forth in claim 6 wherein the drain passageway is formed as a recess in an external surface of the body.

8. In an internal combustion engine as set forth in claim 6 wherein the drain passage comprises a drilled passageway intersecting the well.

* * * * *